US006061854A

United States Patent [19]

Crowley

[11] Patent Number: 6,061,854

[45] Date of Patent: May 16, 2000

[54] ADJUSTABLE NURSING PILLOW ASSEMBLY

[76] Inventor: Sonia S. Crowley, 1540 Glen Cove La., Bellingham, Wash. 98226

[21] Appl. No.: 09/239,923

[22] Filed: Jan. 28, 1999

Related U.S. Application Data

[60] Provisional application No. 60/073,705, Feb. 4, 1998.

[51] Int. Cl.[7] ..... A47D 13/00; A47C 27/14

[52] U.S. Cl. ..... 5/655; 5/640; 5/490; 108/43; 248/118.3

[58] Field of Search ..... 5/655, 640, 646, 5/647, 657, 738, 490; 108/43; 248/118.3, 118.2, 118.1; 224/158, 159

[56] References Cited

U.S. PATENT DOCUMENTS

| | | | |
|---|---|---|---|
| 1,716,145 | 6/1929 | Moudry | 5/490 |
| 3,148,389 | 9/1964 | Lustig | 5/636 |
| 4,235,472 | 11/1980 | Sparks et al. | 5/640 |
| 5,154,649 | 10/1992 | Pender | 5/655 |
| 5,224,637 | 7/1993 | Colombo | 5/655 |
| 5,333,769 | 8/1994 | Skroski | 5/655 |
| 5,551,108 | 9/1996 | Butler, III | 5/655 |
| 5,551,109 | 9/1996 | Tingley et al. | 5/655 |
| 5,572,753 | 11/1996 | Ruscitto | 5/490 |
| 5,581,833 | 12/1996 | Zenoff | 5/655 |
| 5,642,543 | 7/1997 | Huntley | 5/640 |
| 5,790,999 | 8/1998 | Clark | 5/655 |

*Primary Examiner*—Alexander Grosz
*Attorney, Agent, or Firm*—Michael R. Schacht; Hughes & Schacht, P.S.

[57] ABSTRACT

An adjustable pillow assembly for supporting objects on a wearer's lap. The height of the pillow assembly is adjusted by inserting different combinations of lap cushions into a cover member as appropriate for a given individual. The lap cushions may be of equal thickness, in which case three lap cushions would provide three different heights of the pillow assembly. As one alternative, a surface contour of an upper surface of the pillow assembly can be contoured by placing one or more elbow cushions within the cover member on top of the uppermost lap cushion. As another alternative, the lap cushions may be provided in different thicknesses, in which case three lap cushions would provide seven different possible heights to the pillow assembly.

18 Claims, 4 Drawing Sheets

ADJUSTABLE NURSING PILLOW ASSEMBLY

RELATED APPLICATIONS

This application claims priority of U.S. Provisional Application Ser. No. 60/073,705 filed on Feb. 4, 1998.

TECHNICAL FIELD

The present invention relates to nursing systems and methods and, more specifically, to pillows that make nursing more comfortable and productive for mothers and babies.

BACKGROUND OF THE INVENTION

Breastfeeding often requires the nursing mother to sit and support the child being nursed for extended periods of time. If the mother is not comfortable during nursing, the nursing experience can be uncomfortable, frustrating, and unproductive for both mother and baby.

For example, sitting for extended periods in an uncomfortable position may cause a person's body to become tense and can create a feeling of unease or irritability. Such discomfort in a nursing mother can in many cases interfere with lactation. Insufficient lactation can frustrate the child and slow the nursing process, which will have the negative effect of increasing nursing times and the discomfort associated therewith.

The end result of discomfort while nursing is that the mother may elect to discontinue breastfeeding and turn to less desirable alternatives.

RELATED ART

A professional patentability search conducted on behalf of the Applicant has uncovered the following U.S. Patents:

| | | |
|---|---|---|
| 5,581,833 | Zenoff | SUPPORT PILLOW WITH LUMBAR SUPPORT FOR USE IN NURSING AND OTHER APPLICATIONS |
| 4,756,035 | Beier | ORTHOPEDIC PILLOW |
| 5,224,637 | Columbo | WAIST-MOUNTED INFANT CARRIER |
| 5,173,979 | Nennhaus | INFLATABLE LEG AND FOOT SUPPORTING CUSHION WITH REMOVABLE PADDING |
| 5,682,633 | Davis | PILLOW WITH INSERTS |
| 4,235,472 | Sparks et al. | SLEEPING DEVICE FOR SITTING POSITION |
| 4,731,890 | Roberts | PILLOW |
| 5,154,649 | Pender | INFLATABLE NURSING PILLOW |
| 5,092,005 | Byrn | PILLOW FOR USE BY NURSING |
| 5,109,557 | Koy et al. | NURSING PILLOW |

The Zenoff, Pender, Byrn, Roberts, and Koy et al. patents all disclose pillows for use by nursing mothers. Of these pillows, only the pillow disclosed in the Pender patent is adjustable in height to fit different size users.

The Pender pillow comprises an inflatable body that defines three chambers. One or more of the chambers are inflated to provide the structural bulk of the pillow. The inflatable body may be deflated for storage and transportation of the pillow.

In the Applicant's experience, a body inflated with air such as is disclosed in the Pender patent would not provide a sufficiently stable platform for supporting the infant during nursing. In particular, the most support will be needed at the ends of the pillow to support the wearer's elbows. An inflated body as described in the Pender patent will give or compress at these locations and bulge in the middle, resulting in little support at the elbows and, possibly, an unstable platform for the baby in the middle.

In addition, many infants, including newborns, premature babies, and the like require a firm, stable platform during nursing. Any bouncing, rolling, or other movement may cause the baby to release from the nipple and thereby disrupt the nursing process. The inflated body used by the Pender patent would be highly susceptible to such incidental movement that could disrupt the nursing process.

The Columbo patent discloses a waist-mounted infant carrier. This device is not intended to form a resting surface suitable for nursing or the like, but rather helps the user carry an infant on the user's hips.

The Sparks et al. patent discloses a sleeping device having a number of layers of Styrofoam material. These layers are contoured to support a person who is sleeping while in a sitting position. These layers do not appear to be provided with the intent of varying the height of a resting surface; each layer has a specific purpose and could not be eliminated without eliminating a feature of the invention.

The Beier, Nennhaus, and Davis patents all disclose pillows that may be adjusted within limits for different environments. None of these patents disclose forming a support surface for another object (book) or person (baby), nor do they use layers to obtain a support surface having a variable height.

In summary, the Applicant is unaware of any reference that discloses, teaches, or suggests a nursing pillow that employ layers to form a variable height resting surface or batting to form contours on the resting surface.

OBJECTS OF THE INVENTION

From the foregoing, it should be apparent that one object of the present invention is to provide improved nursing pillow assemblies.

Another object of the present invention is to provide a pillow assembly having a favorable balance of the following characteristics:

a. inexpensively manufactured;

b. does not require manufacture, shipment, sale, and storage of an excessive number of separate components; and c. obviates the need for the end user to assemble several parts together.

SUMMARY OF THE INVENTION

The present invention is a pillow assembly that allows the height of the assembly adjusted to accommodate the physical characteristics of the wearer. In particular, each wearer will have a different torso length which will affect the distance between the wearer's lap and the wearer's chest. In the context of nursing mothers, the variability in this distance is important because, if the nursing infant is not adequately supported at chest level, comfortable nursing is less likely.

To accomplish this adjustability, the pillow assembly is provided with a cover member having a cover opening formed therein and defining a pillow chamber. Lap cushions are inserted through this cover opening and into the cover chamber to determine a height of the cover assembly. For persons of smaller stature, only one lap cushion may be employed. For larger persons, two or more lap cushions may be employed.

Preferably, the lap cushions are of even thickness and three different thicknesses can be obtained. As an alternative, three different lap cushions may be provided having different thicknesses and yielding up to seven different overall thicknesses of the pillow assembly. In either case, the lap cushions are preferably formed of a resilient foam material that, when used alone or stacked, provides a stable, secure support surface on which the infant and/or the mother's arms can rest.

The pillow assembly of the preferred embodiment is in the shape of a rectangle with a notch formed therein. The notch accommodates the wearer's waist. A strap is provided to extend around the wearer's waist and secure the pillow assembly onto the wearer's lap.

Optionally, a blanket may be detachably attached to the cover member to cover the baby and provide privacy for the nursing mother and baby.

Also, one or more optional elbow cushions may be provided. These are inserted into the pillow chamber through the cover opening to raise the height of an elbow support region defined by the upper surface or wall of the pillow assembly. The elbow cushions may be folded to obtain yet even a greater increase in height of the pillow assembly within the elbow region.

The cover member is sized and dimensioned to accommodate the largest of the pillow configurations that may be obtained by inserting lap cushions into the pillow chamber. Accordingly, the cover member might be somewhat oversized when the minimum configuration of lap cushions is placed therein. To alleviate any problems that may arise from the oversized cover member, the cover member is designed to fold along one side (preferably the front) and provided with fasteners that maintain the cover member in its folded configuration. The cover member thus can take on at least two configurations as necessary to best accommodate the number and configuration of lap cushions contained therein.

The pillow assembly described above can be manufactured simply and relatively inexpensively. This assembly stably holds the baby (or other object) at chest level and significantly increases the comfort of the user such as a nursing mother or others who wish to support objects on their lap.

DETAILED DESCRIPTION

Figure 1:
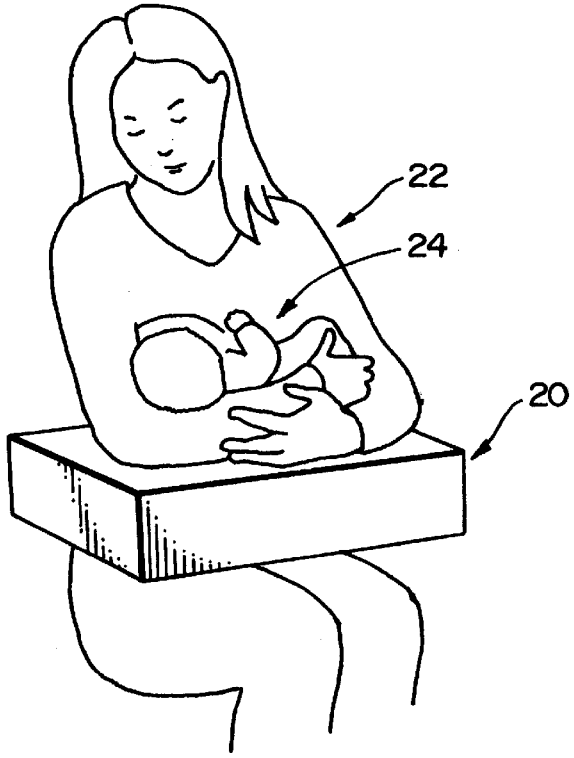
FIG. 1 is a perspective view of a mother nursing a baby using an adjustable nursing pillow constructed in accordance with, and embodying, the principles e present invention.

Referring initially to FIG. 1, depicted therein at 20 is a pillow assembly constructed in accordance with, and embodying, the principles of the present invention. The pillow assembly 20 is being used by a mother 22 to breastfeed an infant 24. While the pillow assembly 20 will be described herein in the context of a nursing mother, the pillow assembly 20 may be used to support other objects such as books, game boards, and the like. The user is not necessarily a mother, and the terms "mother", "user", and "wearer" will be used interchangeably herein.

In FIG. 1, the nursing pillow assembly 20 is used with the infant 24 laying across the front of the mother 22. The infant 24 can extend in either direction across the mother 22. The infant 24 can also lie to either side of the mother 22 with its head in front and feet in back of the mother 22. In addition to breastfeeding, the pillow assembly 20 can be used to facilitate bottle feeding in a similar manner, but the present invention is of greater benefit during breastfeeding.

Using the pillow assembly 20, the mother 22 need not fully support the weight of the infant 24 with her arms. Instead, the pillow assembly 20 transfers the infant's weight to the mother's legs, allowing the mother 22 to use her arms simply to cradle the infant 24. The mother's arms are not tensed during nursing, which is conducive to successful breastfeeding.

Figure 5:
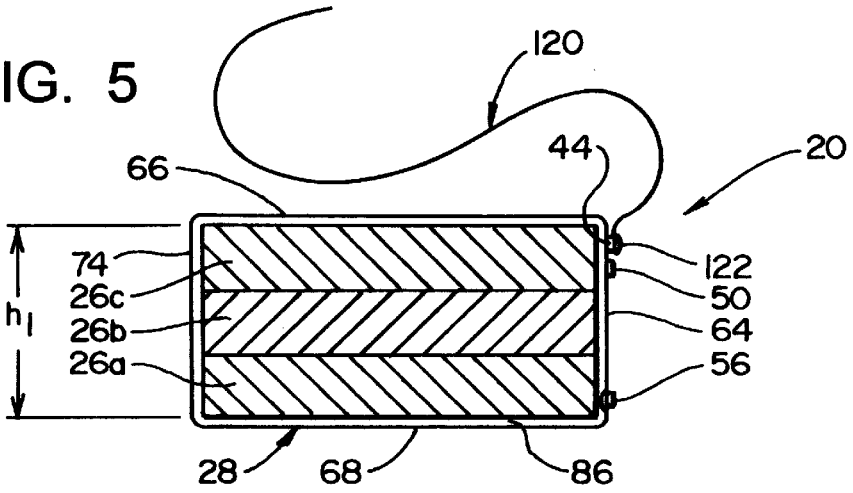
FIG. 5 is a side section view taken along lines 5—5 in FIG. 4 depicting the nursing pillow of FIG. 1 as used in a first configuration and with an option blanket attached thereto.
Figure 6:
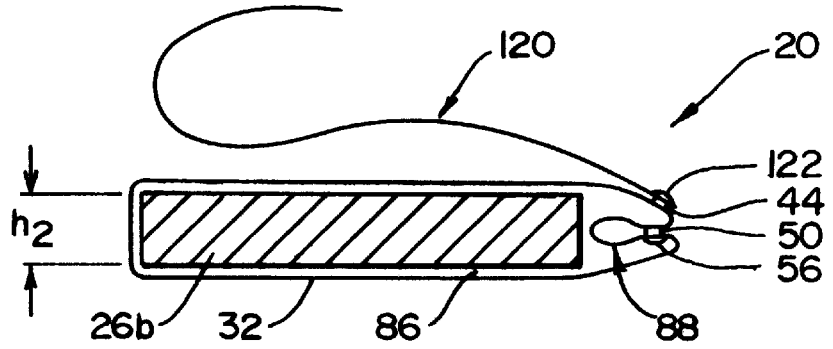
FIG. 6 is a side section view taken along lines 5—5 in FIG. 4 depicting the nursing pillow of FIG. 1 as used in a third configuration and with the optic blanket attached thereto.

Referring for a moment to FIG. 5, it can be seen that pillow assembly 20 comprises a plurality of internal layers 26*a*, 26*b*, and 26*c* that will be referred to herein as lap cushions. The number of lap cushions 26 used determines a height (vertical dimension) of the pillow assembly 20. For example, FIG. 5 shows that the pillow assembly 20 uses the three lap cushions 26*a*, 26*b*, and 26*c* and has a height of h1. In contrast, FIG. 6 shows the pillow assembly with only one lap cushion 26*b* and having a height of h2. Using two lap cushions 26 would result in a third height in between h1 and h2.

In the examples shown in FIGS. 5 and 6, the lap cushions 26*a–c* are identical and thus have the same height (approximately equal to the height h2 described above). This allows three pillow assembly configurations and thus three possible pillow heights as described above. As an alternative, the lap cushions 26 could be provided with three different heights that would allow up to seven different pillow assembly configurations and thus yield a total of seven different pillow heights. Clearly, providing three different pillow sizes provides more pillow height configurations, but this also requires three different pillow sizes to be stocked and shipped with each pillow assembly.

With the foregoing general understanding of the present invention in mind, the details of construction and operation of the pillow assembly 20 will now be described.

Figure 2:
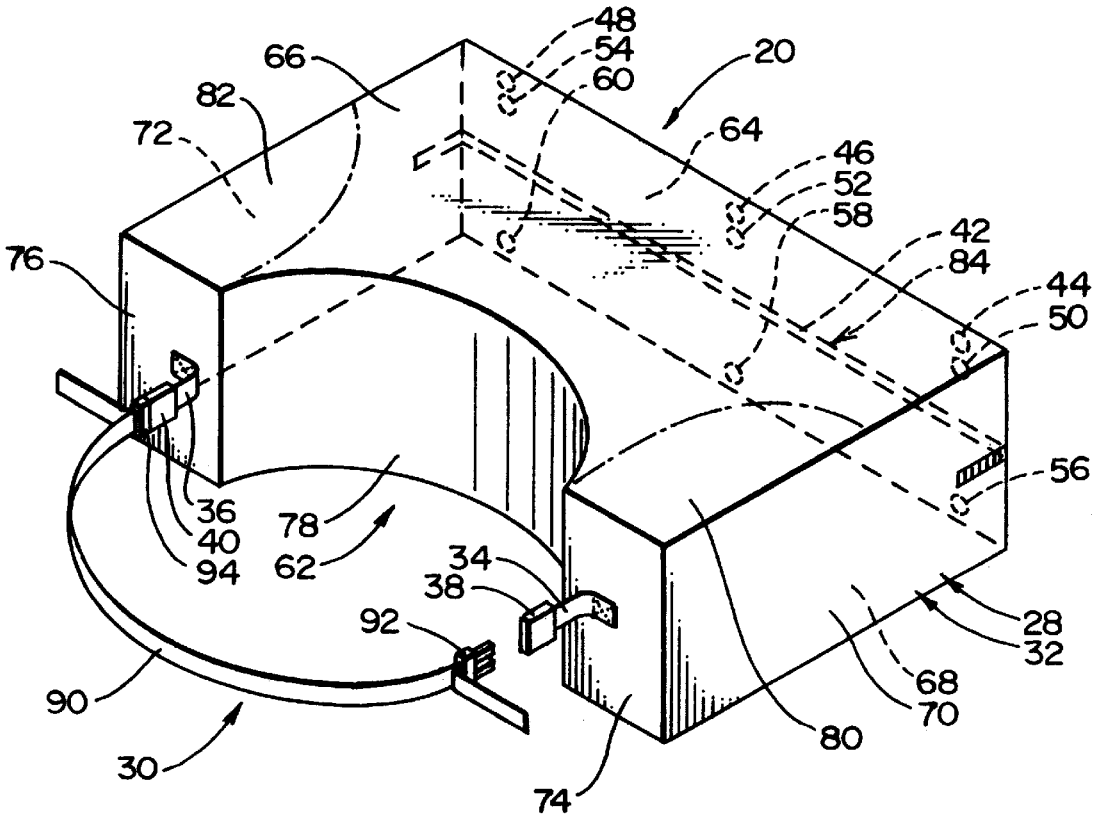
FIG. 2 is a rear perspective view of the nursing pillow of FIG. 1 with certain features shown in hidden lines.

Referring now to FIG. 2, that figure illustrates that the pillow assembly 20 comprises an enclosure assembly 28 for containing the lap cushions (not shown in FIG. 2) and a strap assembly 30.

The enclosure assembly 28 comprises an enclosure member or cover 32, first and second buckle straps 34 and 36, first and second buckle receivers 38 add 40, a zipper assembly 42, first, second, and third blanket snap receivers 44, 46, and 48, first, second, and third enclosure snap receivers 50, 52, and 54, and first, second, and third enclosure snap members 56, 58, and 60.

During use, the cover 32 is generally in the shape of a rectangular solid with a waist notch being formed therein as shown at 62 in FIG. 2. In particular, the cover 32 comprises a front wall 64, a top wall 66, a bottom wall 68, first and second side walls 70 and 72, first and second rear walls 74 and 76, and a notch wall 78.

The front wall 64, first and second side walls 70 and 72, and first and second rear walls 74 and 76 are rectangular and will be generally vertical during the use configuration shown in FIGS. 2 and 5. The top wall 66 and bottom wall 68 are generally rectangular minus arched notch portions defined by the waist notch 62. The top and bottom walls 66 and 68 will be horizontally oriented during normal use. The notch wall 78 would be rectangular if laid out flat but is curved in the context of the pillow assembly 20. The notch wall 78 is also generally vertical during normal use.

The mother's stomach will be immediately adjacent to the notch wall 78 when the pillow assembly 20 is used. The pillow assembly 20 extends around the mother 22 such that elbow regions 80 and 82 (shown be dash-dot lines in FIG. 2) are formed on the top wall 66 adjacent to the side walls 70 and 72 and rear walls 74 and 76. Often, as their name suggests, the elbow regions 80 and 82 support the user's elbows during nursing, reading, or the like. During nursing, one of the elbow regions 80 and 82 will often lie under the baby's head; the baby's head may thus rest directly on one of the elbow regions 80 and 82.

The top wall 66 forms a support surface on which objects, such as an infant, the mother's elbows, a book, or the like, may be supported during use. And as will be discussed in detail below, the height of the pillow assembly 20 within these elbow regions 80 and 82 is adjustable to accommodate the specific manner in which the pillow assembly 20 is used. The height of the pillow assembly 20 thus need not be constant along its entire upper surface, but instead can be contoured as necessary for a given situation.

The first and second buckle straps 34 and 36 are securely attached by sewing, adhesives, or the like to the first and second rear walls 74 and 76, respectively. The first and second buckle receivers 38 and 40 are secured to the buckle straps 34 and 36, respectively.

Figure 4:
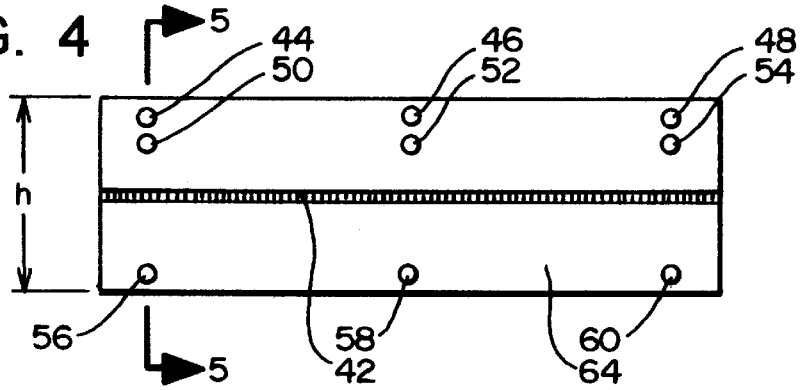
FIG. 4 is a elevation view depicting the nursing pillow of FIG. 1 without an optional blanket.

As perhaps best shown in FIG. 4, the zipper assembly 42 is sewn to the front wall 64 about half-way between the top and bottom walls 66 and 68 and extends a short distance along the first and second side walls 70 and 72. The blanket snap receivers 44–46 are securely attached to the front wall 64 adjacent to the top wall 66 at symmetrically spaced locations. The enclosure snap receivers 50–54 are securely attached to the front wall 64 immediately below the blanket snap receivers 44–46 at symmetrically spaced locations above the zipper assembly 42. The enclosure snap members 56–60 are securely attached to the front wall 64 below the enclosure snap receivers 50–54 and the zipper assembly 42 at symmetrically spaced locations adjacent to the bottom wall 68.

The zipper assembly 42 allows access through a zipper opening 84 (FIG. 2) to a pillow chamber 86 formed by the cover 32. The lap cushions 26*a–c* may be removed from and inserted into the pillow chamber 86 simply by moving the zipper assembly 42 into its open configuration. The zipper assembly 42 may extend across substantially the full length of the front wall 64 but not the side walls 70 and 72 and still will allow most lap cushions to be inserted into and removed from the pillow chamber 86.

As shown in FIG. 5, the enclosure snap receivers 50–54 and members 56–60 are not used when all three lap cushions 26*a–c* are used. When only one of the lap cushions 26*b* is used as shown in FIG. 6, the container assembly is too large for the single lap cushion. In this case, the front wall is folded over as shown at 88 in FIG. 6 and the snap members 56–60 are inserted into the snap receivers 50–54 to form snap assemblies that maintain the fold 86. This takes up excess slack in the cover 32 and ensures a tight fit that prevents unwanted movement of the lap cushion 26*b* within the cover 32. Alternatives to these snap assemblies include hook and loop fasteners, fabric ties, or simply elastic bands sewn to the top and bottom walls 66 and 68 of the cover 32.

The strap assembly 30 comprises a strap member 90 and first and second buckle members 92 and 94. The strap member 90 is an elongate piece of fabric webbing material. The buckle members 92 and 94 engage the buckle receivers 38 and 40 to form buckle assemblies that attach the strap member 90 to the cover member 32. The strap member 90 thus extends around the mother's waist to ensure that cover member 32 does not move away from the mother 22 during use. The buckle members 92 and 94 are conventionally attached to the strap member 90 so that the mother can adjust the effective length of the strap member 90 as necessary by pulling either end of the strap member 90.

In the exemplary pillow assembly 20, two buckle assemblies are formed by the buckle members 92,94 and buckle receivers 38,40, one on each end of the strap 90. This allows the mother to use either hand to remove the strap member 90 as is convenient. Alternatively, one end of the strap 90 can be fixedly connected to one of the rear walls 74 and 76 of the cover member 32. In this case, only one buckle assembly will be required, but only one end of the strap 90 can be disconnected. In addition, other fasteners, such as hook and loop fasteners, fabric ties, zippers, or the like, may be used in place of the two piece buckle assemblies described herein.

Figure 3:
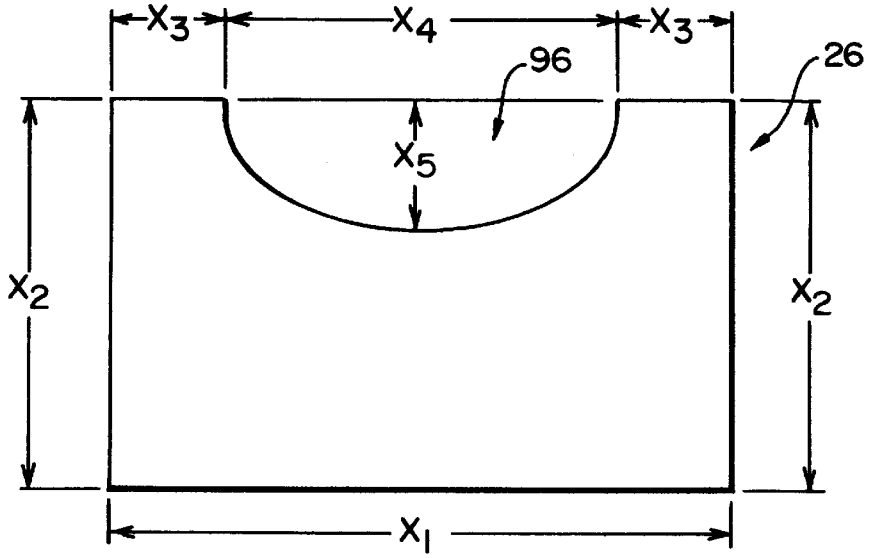
FIG. 3 is a top plan of a lap cushion employed by the nursing pillow of FIG. 1

FIG. 3 depicts a top plan view of the lap cushions 26. These lap cushions 26 provide the notched rectangular structure to the pillow assembly 20 described above. The lap cushions 26 are thus generally in the shape of a rectangular solid with a curved notch 96 formed therein. The notch is sized and dimensioned to extend around at least a portion of the waist of the mother. With the exemplary lap cushions 26, the notch 96 extends along approximately three-fifths of a back wall of the cushion 26 and approximately one-third of the way from the back wall towards the front wall of the cushion 26. The exemplary notch 96 is generally ovoid.

Figure 9:
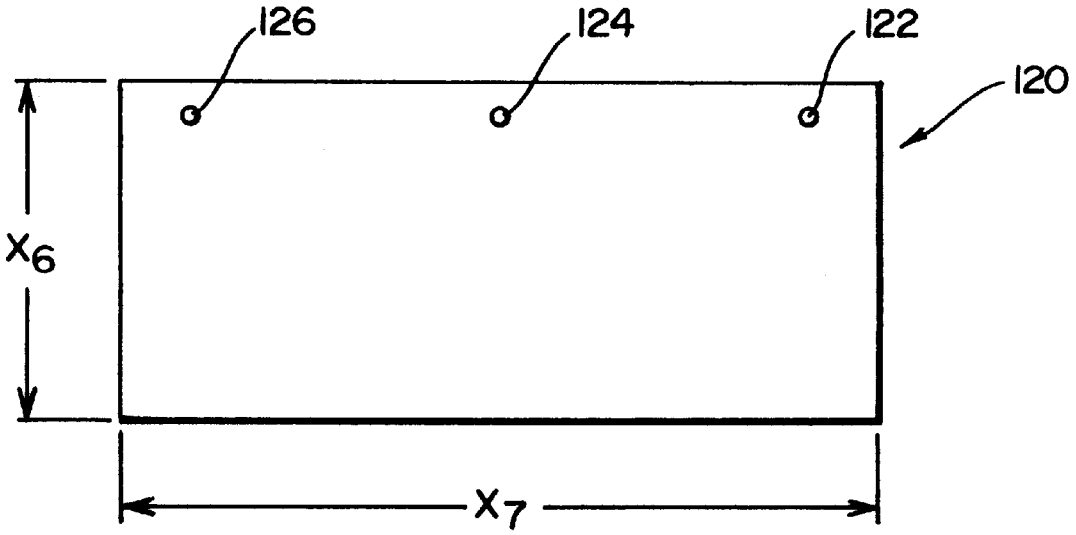
FIG. 9 is a top plan view depicting an optional blanket that can form a part of the nursing pillow of the present invention.

FIG. 5 depicts a blanket member 120 that is preferably used as part of the pillow assembly 20. The blanket member 120 is a rectangular sheet of material that is detachably attached to the cover member 32 using the blanket snap receivers 44–48 described above. In particular, as shown in FIG. 9 the blanket member 120 comprises first, second, and third blanket snap members 122, 124, and 126. As generally shown in FIGS. 5 and 6, these snap members 122–126 engage the blanket snap receivers 44–48 to form snap assemblies that fix the blanket member 120 to three points on the cover member 32.

When used, the blanket member 120 serves at least the following functions. First, the blanket member 120 acts as a warming blanket (or the infant 24 and/or a privacy blanket for the mother 22 and infant 24. The blanket member 120 can also be used as a changing blanket for changing the infant's diapers when necessary. The blanket member can be used to form an outer compartment for carrying items. Additionally, the blanket member 120 can be placed underneath the infant while nursing to catch spills and the like that occur during and after nursing. While the cover 32 is washable, it is simpler to remove and wash the blanket member 120 than it is to prepare the cover 32 for washing.

Additional fastening assemblies may be provided on the blanket 120 and/or cover member 32 to facilitate the use of the blanket member as a privacy blanket and/or to form an outer compartment.

Figure 7:
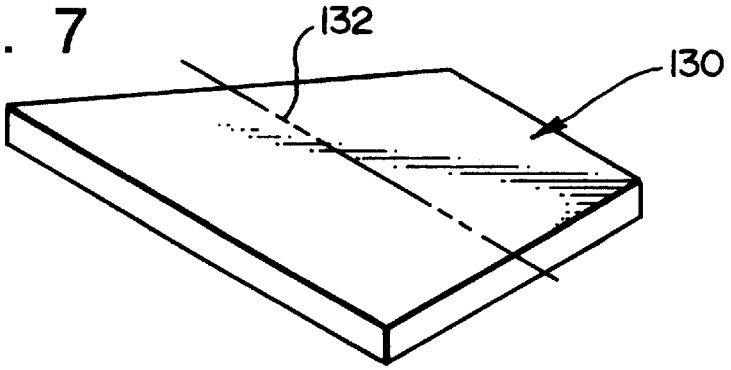
FIG. 7 is a perspective view of an optional elbow cushion that may be used in connection with the present invention.

Referring now to FIG. 7, depicted at 130 therein is an elbow cushion that may be used as part of the pillow assembly 20. The elbow cushion 130 is a flat sheet of soft or resilient material similar. The elbow cushion 130 is capable of being bent or folded such as along the broken line 132 shown in FIG. 7.

Two elbow cushions 130 are preferably provided with each pillow assembly 20, but one or none of these may be used depending upon the circumstances. When used, the elbow cushions 130 are preferably inserted between the uppermost lap cushion 26 and the cover 32 to allow the user to contour the upper surface of the pillow assembly 20 for a given situation. The use of the elbow cushions 130 is optional, and these may be used in at least the two configurations shown in FIG. 8.

Figure 8:
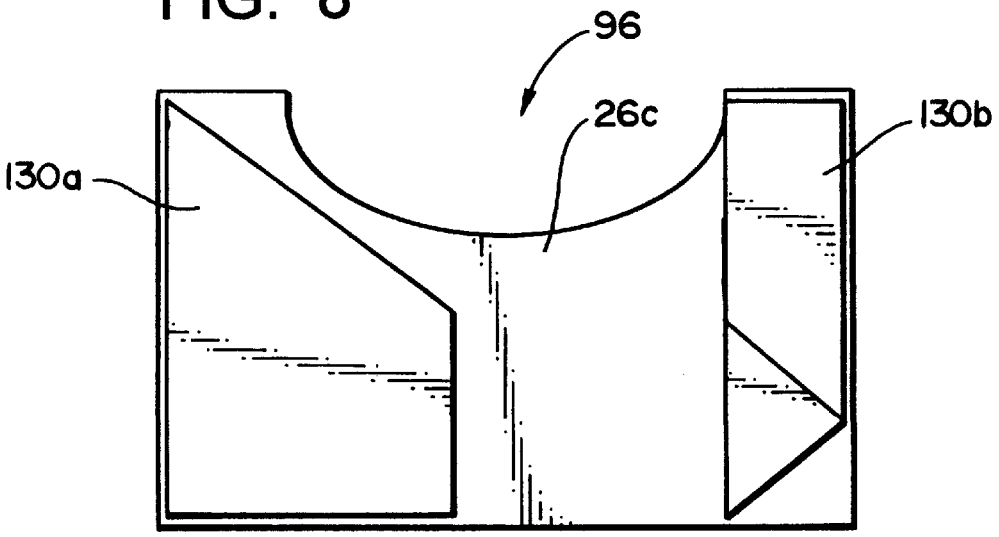
FIG. 8 is a top plan view depicting how the elbow cushion may be used in connection with one or more lap cushions.

In FIG. 8, the cover member 32 is not shown for purposes of clarity. The elbow cushions 130 lie on top of the uppermost lap cushion 26*c*. The elbow cushion 130*a* is laid out flat to raise one of the elbow regions 80. The elbow cushion 130*b*, on the other hand, is folded over to raise the other elbow region 82 a greater amount. Typically, the same configuration of elbow cushion would be used on both ends of the pillow assembly 20, but the configuration shown in FIG. 8 may be desirable in some situations.

The exemplary elbow cushions 130 are generally in the shape of a quadrilateral formed by joining a rectangle and a right triangle formed by a line bisecting the rectangle. This shape allows the elbow cushion to cover almost one-half of the top wall 66 but still avoid the notch 96.

The elbow cushions thus provide a way of contouring the top wall 66 in addition to the process of changing the height (distance between the top and bottom walls 66 and 68) as described above. Again, the adjustability of the pillow assembly 20 increases the comfort of both the mother 22 and the infant 24.

Various dimensions of the exemplary pillow assembly 20 are labeled in FIGS. 3–4. The following Table A provides the preferred values and first and second preferred ranges of values that may be used to manufacture a pillow assembly according to the teachings of the present invention.

TABLE A

| DIMENSION | PREFERRED | FIRST PREFERRED RANGE | SECOND PREFERRED RANGE |
|---|---|---|---|
| X1 | 19" | 19 ± 2" | 19 ± 4" |
| X2 | 12" | 12 ± 2" | 12 ± 4" |
| X3 | 3½" | 3½ ± 2" | 3½ ± 3" |
| X4 | 12" | 12 ± 2" | 12 ± 4" |
| X5 | 4" | 4 ± 2" | 4 ± 3" |
| X6 | 16" | 16 ± 2" | 16 ± 4" |
| X7 | 19" | 19 ± 2" | 19 ± 4" |
| h | 2–6" | 1" to 8" | 1" to 12" |

The present invention may also be embodied in a slightly larger version for women nursing twins. With twins, it is possible to nurse two babies at one time with the babies extending on both sides of the mother. A pillow assembly optimized for use with two babies will have dimensions as set forth in Table B below.

TABLE B

| DIMENSION | PREFERRED | FIRST PREFERRED RANGE | SECOND PREFERRED RANGE |
|---|---|---|---|
| X1 | 27" | 27 ± 2" | 27 ± 4" |
| X2 | 12" | 12 ± 2" | 12 ± 4" |
| X3 | 3½" | 3½ ± 2" | 3½ ± 3" |
| X4 | 12" | 12 ± 2" | 12 ± 4" |
| X5 | 4" | 4 ± 2" | 4 ± 3" |
| X6 | 16" | 16 ± 2" | 16 ± 4" |
| X7 | 19" | 19 ± 2" | 19 ± 4" |
| h | 2–6" | 1" to 8" | 1" to 12" |

The following Table C sets forth the preferred materials or products that may be used to construct the pillow assembly 20 along with several possible alternatives to the preferred material or product.

TABLE C

| ELEMENT | PREFERRED | ACCEPTABLE ALTERNATIVE(S) |
|---|---|---|
| Buckle assemblies (38,92), (40,94) | 1" plastic buckles | ½–3" plastic buckles; hook and loop fasteners; fabric ties |
| Snap assemblies (50,56), (52,58), (54-60), (44,122), (46,124), (48,126) | Medium size fabric snaps | Hook and loop fasteners; fabric ties |
| Webbing material 34, 36, 90 | Polypropylene | Cotton; Nylon |
| Zipper assembly 42 | Size 2–4 | Size 2–10 |
| Fabric panels 150, 152 | Cotton, polyester, polyester/cotton, and/or vinyl | Equivalent |
| Blanket member 120 | Cotton, polyester, polyester/cotton, and/or vinyl | Equivalent |
| Lap cushions 26 | Open cell foam | Closed cell foam |
| Elbow cushions 130 | Polyester batting; cotton covered by cloth | Equivalent |

From the foregoing, it should be recognized that various modifications can be made without departing from the basic teaching of the present invention. For example, while of particular relevance to the breastfeeding of infants, the pillow assembly of the present invention may be used in other situations, such as reading books, where lap and elbow support platforms would give comfort to the user.

Additionally, numerous buckle and snap assemblies were described above for use as connectors. The described connecting assemblies are conventional, and other conventional connecting assemblies such as simple fabric ties or hook and loop fasteners may be used instead.

Another modification to the pillow assembly 20 described above would be to add one or more pockets for storage of such items as bottles, diapers, cellular telephones, and the like. The likely location for such pockets would be the first and second side walls 70 and 72 and, perhaps, the front, top, and bottom walls 64, 66, and 68. Less likely but possible locations would be the top wall 66, the back walls 74 and 76, and the notch wall 78.

The scope of the present invention should thus be determined by the following claims and not the foregoing detailed description.

What is claimed is:

1. A pillow assembly adapted to be worn by a wearer to allow the wearer to support an object above a lap of the wearer, comprising:

a flexible cover member defining a pillow chamber and having a pillow opening formed therein;

a plurality of lap cushions adapted to be inserted through the pillow opening into the pillow chamber in a plurality of pillow configurations, where each pillow configuration comprises at least one lap cushion and a height of the pillow is determined by the number of lap cushions within the pillow chamber;

a blanket attached to the cover member;

snap fasteners to allow the blanket to be detachable attached to the cover members; and at least one elbow cushion placed on elbow supporting portions of the lap cushions for altering a contour of the pillow assembly; wherein the wearer selects one of the pillow configurations based on a desired height of the object above the wearer's lap.

2. A pillow assembly as recited in claim 1, further comprising closing means for selectively closing the pillow opening.

3. A pillow assembly as recited in claim 2, in which the closing means comprises a zipper.

4. A pillow assembly as recited in claim 1, further comprising strap means for extending around a waist the wearer to secure the cover member and lap cushions on the wearer's lap.

5. A pillow assembly as cited in claim 4, in which the strap means comprises a strap member and at least buckle assembly configured to allow an end of the strap member to be detachably attached to the cover member.

6. A pillow assembly as recited in claim 1, further comprising fastening means to allow the cover member to be placed into a folded configuration when the height of the pillow assembly is reduced.

7. A pillow assembly as recited in claim 1, further comprising at least one elbow cushion that is placed within the pillow chamber to adjust the height of the pillow assembly within an elbow support region.

8. A pillow support assembly as recited in claim 7, in which the elbow cushion is folded over to further increase the height of the pillow assembly within the elbow support region.

9. A method of supporting an infant above a lap of a wearer for feeding of the infant by the wearer, comprising the steps of:

providing a flexible cover member defining a pillow chamber and having a pillow opening formed therein;

providing a plurality of lap cushions;

determining a desired height of the infant above the wearer's lap based on physical characteristics of the wearer, where the desired height substantially optimizes stability and comfort of the infant and the wearer during feeding;

identifying a desired lap cushion configuration corresponding to a number of lap cushions inserted through the pillow opening into the pillow chamber;

inserting at least one lap cushion corresponding to the desired lap cushion configuration through the pillow opening into the pillow chamber to form a pillow assembly having a height approximately equal to the desired object height;

placing the pillow assembly on the wearer's lap;

placing the infant on the pillow assembly; and feeding the infant.

10. A method as recited in claim 9, further comprising the steps of selectively opening the pillow opening to insert and remove lap cushions from the pillow chamber.

11. A method a recited in claim 10, further comprising the step of providing a zipper to allow the pillow opening to be closed.

12. A method as recited in claim 9, further comprising the step of strapping the cover member to a waist of the wearer to secure the cover member and lap cushions on the wearer's lap.

13. A method as recited in claim 9, further comprising the step of detachably attaching a blanket to the cover member.

14. A method as recited in claim 9, further comprising the step of folding a portion of the cover member when the height of the pillow assembly is reduced.

15. A method as recited in claim 9, further comprising the step of adjusting a contour of an upper surface of the pillow assembly by placing at least one elbow cushion within the pillow chamber.

16. A method as recited in claim 15, further comprising the step of folding the elbow cushion.

17. An adjustable pillow assembly adapted to facilitate feeding of an infant by users of different physical characteristics, the adjustable pillow assembly comprising:

a flexible cover member defining a pillow chamber and having a pillow opening formed therein;

a plurality of lap cushions adapted to be inserted through the pillow opening into the pillow chamber in one of a plurality of lap cushion configurations, where each lap cushion configuration comprises at least one lap cushion and a height of the pillow is determined by the number of lap cushions within the pillow chamber, the lap cushions determine a shape of the pillow assembly, and the lap cushions are configured with a notch formed therein for receiving a waist of the user; wherein the user selects one of the pillow configurations based on the user's physical characteristics and a desired height of the infant above the user's lap to substantially optimize stability and comfort of the infant and the user during feeding.

18. A pillow assembly as recited in claim 17, further comprising fastening means for allowing the cover member to be placed into a folded configuration when the height of the pillow assembly is reduced.

* * * * *